US011845284B2

(12) United States Patent
Forcada Pardo et al.

(10) Patent No.: US 11,845,284 B2
(45) Date of Patent: Dec. 19, 2023

(54) PRINT HEAD MAINTENANCE CARTRIDGE

(71) Applicant: Hewlett-Packard Development Company, L.P., Spring, TX (US)

(72) Inventors: Santiago Forcada Pardo, Sant Cugat del Valles (ES); Javier Deocon Mir, Sant Cugat del Valles (ES); Alejandro Mielgo Barba, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 149 days.

(21) Appl. No.: 17/312,121

(22) PCT Filed: Dec. 20, 2018

(86) PCT No.: PCT/US2018/066871
§ 371 (c)(1),
(2) Date: Jun. 9, 2021

(87) PCT Pub. No.: WO2020/131074
PCT Pub. Date: Jun. 25, 2020

(65) Prior Publication Data
US 2022/0040984 A1 Feb. 10, 2022

(51) Int. Cl.
*B41J 2/165* (2006.01)

(52) U.S. Cl.
CPC ..... *B41J 2/16547* (2013.01); *B41J 2/16535* (2013.01); *B41J 2/16538* (2013.01); *B41J 2/16544* (2013.01); *B41J 2002/1655* (2013.01)

(58) Field of Classification Search
CPC ..... B41J 2/16547; B41J 2/16535; B41J 2/16538; B41J 2/16544; B41J 2002/1655
See application file for complete search history.

(56) References Cited

U.S. PATENT DOCUMENTS

| | | | | |
|---|---|---|---|---|
| 2,164,363 | A | 7/1939 | Waters | |
| 6,692,100 | B2 | 2/2004 | Steinfeil et al. | |
| 8,777,372 | B2 | 7/2014 | Inoue | |
| 9,308,730 | B2 | 4/2016 | Maida et al. | |
| 9,498,959 | B2 | 11/2016 | Shinoto et al. | |
| 10,449,767 | B2 * | 10/2019 | Fujioka | B41J 2/16544 |
| 2016/0090243 | A1 | 3/2016 | Aliesch | |
| 2018/0001645 | A1 | 1/2018 | Fujioka et al. | |
| 2018/0264822 | A1 | 9/2018 | Tanioku et al. | |

FOREIGN PATENT DOCUMENTS

| | | | |
|---|---|---|---|
| EP | 3254855 | A1 | 12/2017 |

* cited by examiner

*Primary Examiner* — Geoffrey S Mruk

(57) ABSTRACT

Disclosed herein is a print head maintenance cartridge, a printing device and a method of controlling a wiping subsystem of a print head maintenance cartridge. The print head maintenance cartridge comprises a wiping subsystem with a wiping material to wipe a print head; a clean material roll, wherein a clean part of the wiping material is rolled up on the clean material roll at least in part; a brake to generate a first brake force applied to the wiping material; and a friction element to generate a second brake force applied to the wiping material, wherein the friction element compensates at least in part a change in the first brake force to control a total brake force, wherein the total brake force is the sum of the first and second brake forces.

8 Claims, 7 Drawing Sheets

PRINT HEAD MAINTENANCE CARTRIDGE

BACKGROUND

Printing devices like ink-jet printers may have to be cleaned regularly to maintain image quality and e.g. prevent partial or complete clogging of print head nozzles. To this end, printing devices can comprise a maintenance subsystem to perform cleaning operations on a print head of the printing device.

BRIEF DESCRIPTION OF DRAWINGS

In the following, a detailed description of various examples is given with reference to the figures. The figures show schematic illustrations of FIG. 1: a wiping subsystem in accordance with an example in side view.

DETAILED DESCRIPTION

To clean a print head, a printing device can comprise a maintenance cartridge with a number of subsystems for performing cleaning operations. The maintenance cartridge can for example comprise a wiping subsystem with a wiping material, which can be brought in contact with the print head to wipe off contaminants from the print head. To ensure an effective cleaning, a tension may be created in the wiping material, e.g. by generating a driving force in the wiping material and countering the driving force with a brake force. The brake force may vary over time, which can cause problems as the tension in the wiping material may increase or decrease.

Figure 1:
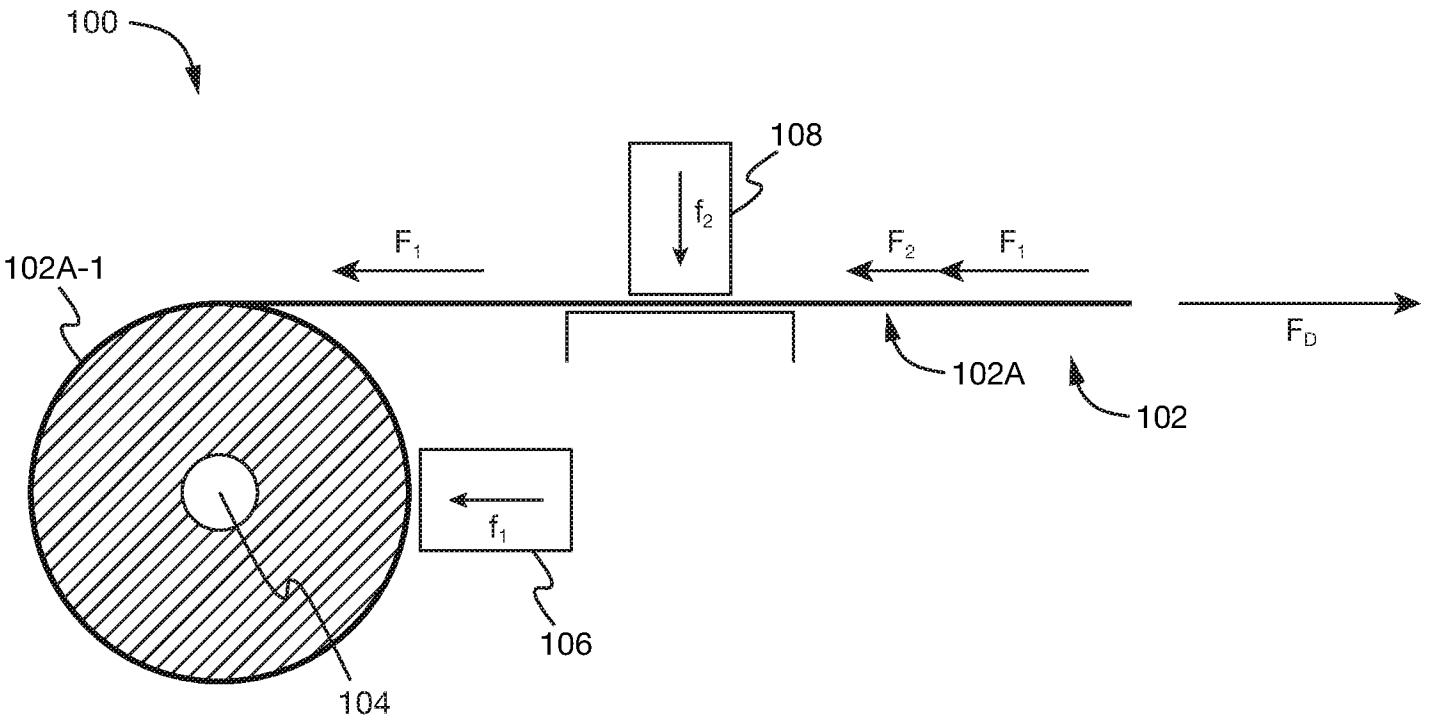

FIG. 1 depicts a wiping subsystem 100 according to an example in side view. The wiping subsystem 100 may for example be part of a maintenance cartridge in a printing device (not shown in FIG. 1). The wiping subsystem 100 comprises a wiping material 102 to wipe a print head. The wiping material 102 may for example be a continuous microfiber textile or web wipe. The wiping material 102 comprises a clean part 102A to be used to clean the print head. At least a portion 102A-1 of the clean part 102A is rolled up on a clean material roll 104, which may e.g. be a rotatably mounted cylinder or tube. By rotating the clean material roll 104, the wiping material 102 may be unrolled from the clean material roll 104. In some examples, the clean material roll 104 may be coupled to an actuator to rotate the clean material roll 104, e.g. an electric motor.

The wiping subsystem 100 further comprises a brake 106 to generate a first brake force $F_1$ applied to the wiping material 102. The first brake force $F_1$ may for example be applied along a longitudinal direction of the wiping material 102, wherein the longitudinal direction is the direction of the wiping material 102 along which the wiping material 102 is rolled-up on the clean material roll 104. The first brake force $F_1$ may either be a static force like friction that opposes any dynamic force applied to accelerate the wiping material 102 or may be a dynamic force that can accelerate the wiping material 102. In one example, the brake 106 comprises a brake shoe, which is pressed against the wiping material 102 with a force $f_1$ to generate the first brake force $F_1$. The brake shoe may for example be pressed against the portion 102A-1 of the wiping material 102 that is rolled up on the clean material roll 104. In another example, the brake 106 may be part of or coupled to the clean material roll 104. The brake 106 may for example create friction that has to be overcome in order to rotate the clean material roll 104, e.g. by pressing a brake shoe against the clean material roll. Alternatively, the brake 106 may generate a torque on the clean material roll 104, e.g. using the actuator. The torque may for example be generated to resist rotation of the clean material roll 104.

The wiping subsystem 100 also comprises a friction element 108 to generate a second brake force $F_2$ along the wiping material 102. The friction element 108 may be similar to the brake 106. The friction element 108 may e.g. be pressed against the wiping material 102 with a force $f_2$ to generate the second brake force $F_2$. In other examples, the friction element 108 may be a static element at a fixed position that is in contact with the wiping material 102 as detailed below with reference to FIGS. 2*a* and 2*b*, wherein the second brake force $F_2$ results from friction between the friction element 208 and the wiping material 102.

The first and second brake forces add up, yielding a total brake force $F_B=F_1+F_2$ along the wiping material 102. The total brake force $F_B$ is the force that has to be overcome to move the wiping material 102. The total brake force $F_B$ may for example counteract a driving force $F_D$, which may e.g. be applied to the wiping material 102 to generate a tension in the wiping material 102 or to unroll the wiping material 102 from the clean material roll 104. If the driving force $F_D$ is smaller than the total brake force $F_B$, the total brake force $F_B$ prevents the wiping material 102 from moving.

The friction element 108 compensates at least in part a change in the first brake force $F_1$ to control the total brake force $F_B$. The friction element 108 may for example compensate at least in part a decrease in the first brake force $F_1$ by an increase in the second brake force $F_2$ or an increase in the first brake force $F_1$ by a decrease in the second brake force $F_2$. The friction element 108 can compensate a change in the first brake force $F_1$ to maintain the total brake force $F_B$ to be constant or about constant. In one example, the friction element 108 keeps the total brake force $F_B$ in a target range, e.g. a range between 80% and 120% of a target value.

The friction element 108 may e.g. be connected to a controller (not shown in FIG. 1) that determines the first brake force $F_1$ and adjusts the second brake force $F_1$ accordingly. Alternatively or additionally, the brake 106 and the friction element 108 may be arranged such that a change in the first brake force $F_1$, e.g. due to a change in the force $f_1$, leads to or is associated with a change of a path along which the wiping material 102 extends. This change of the path of the wiping material 102 may lead to a change in the second brake force $F_2$, e.g. by changing the force $f_2$ or by changing a size of a contact area between the friction element 108 and the wiping material 102. One example for this is described in more detail below with reference to FIGS. 2*a* and 2*b*. In another example, the brake 106 and the friction element 108 may be adjacent to each other and may press against the wiping material from the same side with the forces $f_1$ and $f_2$, respectively, e.g. using two springs. A decrease in $f_1$ may lead to an increase in $f_2$, e.g. due to a compression of a spring in the friction element 108 by the wiping material 102 as a result of the decrease in $f_1$.

Figure 2A:
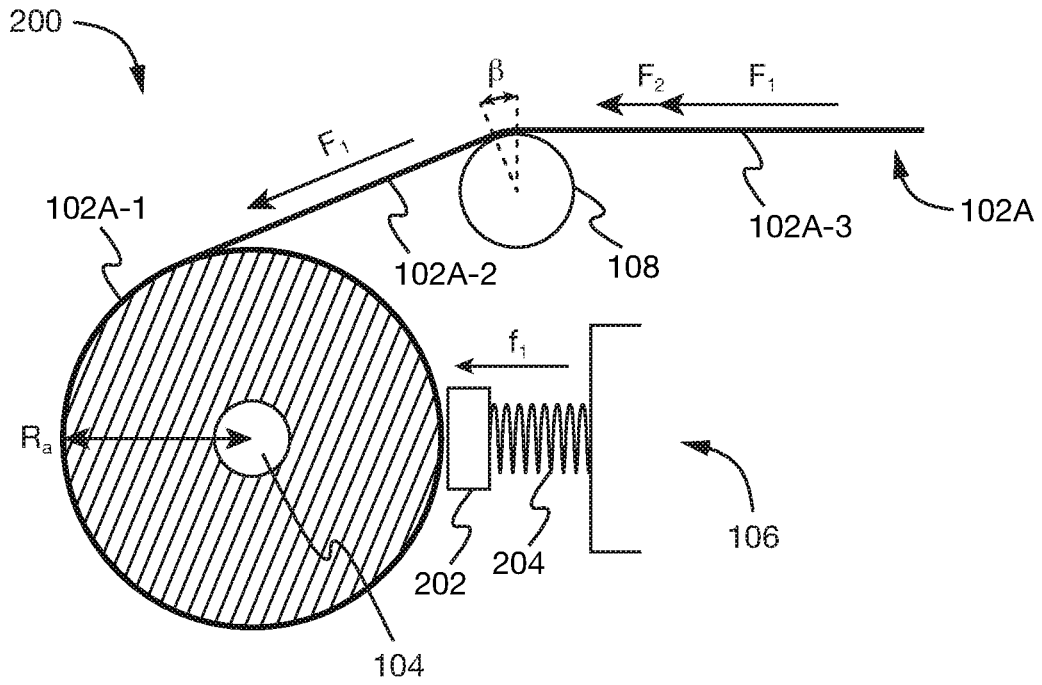
FIG. 2*a*: a wiping subsystem with a friction rod and a large amount of wiping material on a clean material roll in accordance with an example in side view.
Figure 2B:
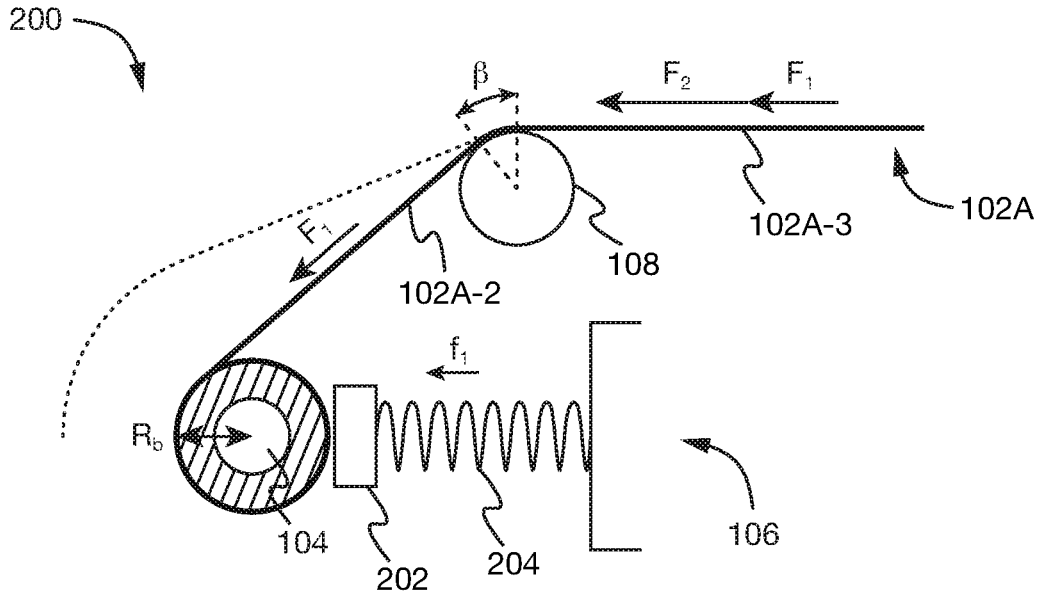
FIG. 2*b*: the wiping subsystem of FIG. 2*b* with a small amount of wiping material on the clean material roll in side view.

FIGS. 2*a* and 2*b* illustrate another example of a wiping subsystem 200 in side view. The wiping subsystem 200 also comprises a wiping material 102, a clean part 102A of which is partially rolled up on a clean material roll 104. FIG. 2*a* depicts the wiping subsystem 200 in a state in which a major portion 102A-1 of the wiping material 102 is rolled up on the clean material roll 104, whereas FIG. 2*b* shows the wiping subsystem 200 in a state in which a smaller portion 102A-1 of the wiping material 102 is rolled up the clean material roll 104.

The wiping subsystem 200 further comprises a brake 106 to generate a first brake force $F_1$ along a longitudinal direction of the wiping material 102 in a first portion 102A-2 of the clean part 102A of the wiping material 102. The brake 106 comprises a spring 204 to press a brake shoe 202 with a force $f_1$ against the clean part 102A of the wiping material 102, e.g. the portion 102A-1 of the clean part 102A that is rolled up on the clean material roll 104. One end of the spring 204 may be attached to a frame of the wiping subsystem 200 or of a maintenance cartridge comprising the wiping subsystem 200. The brake shoe 204 may for example consist of or comprise plastic, rubber or metal.

The wiping subsystem 200 further comprises a friction element 108 to generate a second brake force $F_2$ along the wiping material 102. The friction element 108 is to convert the first brake force $F_1$ in the first portion 102A-2 to a friction force along the longitudinal direction of the wiping material 102 in a second portion 102A-3 of the clean part 102A of the wiping material 102 to generate the second brake force $F_2$. In this example, the friction force corresponds to the total brake force $F_B$. The friction force is to be understood as a force that arises at least in part from friction between the wiping material 102 and the friction element 108. Converting the first brake force $F_1$ to the friction force refers to modifying the force acting along the longitudinal direction of wiping material 102 such that the friction force acts in the second portion 102A-3 instead of the first brake force $F_1$ if the first brake force $F_1$ is applied in the first portion 102A-2. This may comprise changing a direction and/or magnitude of the first brake force $F_1$. The first portion 102A-2 may lie between the friction element 108 and the portion 102A-1 of the clean part 102A that is rolled up on the clean material along 104. The second portion 102A-3 may lie between the friction element 108 and a cleaning part 102B (not shown in FIGS. 2*a* and 2*b*) of the wiping material 102 that is to be brought in contact with a print head.

The friction element 108 is in contact with the wiping material 102, e.g. with a portion of the wiping material 102 connecting the first 102A-2 and second portions 102A-3. The friction element may divert the wiping material 102 by a deflection angle, i.e. may change a longitudinal direction into which the wiping material 102 extends in the second portion 102A-3 as compared to the first portion 102A-2. Contact between the friction element 108 and the wiping material 102 can generate the friction force, wherein the second brake force $F_2$ may correspond to the friction caused by the friction element 108 that adds to the first brake force $F_1$. The second brake force $F_2$ may e.g. depend on the direction and magnitude of the first brake force $F_1$, the size of a contact area between the wiping material 102 and the friction element 108, the deflection angle, the wiping material 102 and/or a surface material of the friction element 108.

In the example shown in FIGS. 2*a* and 2*b*, the friction element 108 is a cylindrical rod extending in the direction of view. Alternatively, the friction element 108 may have a different shape and may e.g. be a rod with an elliptical, rectangular, hexagonal or irregularly shaped cross section. The portion of the wiping material 102 connecting the first portion 102A-2 and the second portion 102A-3 is wrapped around the rod 108 spanning a contact angle β. The contact angle β is the angle enclosed by the first and last points of contact between the friction element 108 and the wiping material 102 with respect to the center of the rod 108 as illustrated by the dashed lines in FIG. 2*a*. The contact angle β may be equal to the deflection angle. For a cylindrical rod, the friction between the rod 108 and the wiping material 102 can be modeled using the Capstan equation, also known as the belt friction equation, which relates the second brake force $F_2$ to the first brake force $F_1$ and the contact angle β:

$$F_2=F_1(e^{\mu\beta}-1)$$

wherein μ is a static friction coefficient, which can e.g. depend on the wiping material 102, the surface material of the rod 108 and a structure of the respective surfaces. According to the Capstan equation, the second brake force $F_2$ increases exponentially with the contact angle β such that a small change in the contact angle β can lead to a drastic change in the second brake force $F_2$. If the friction element 108 has a different shape, the relation between the first $F_1$ and second brake forces $F_2$ may differ from the Capstan equation. In general, however, the second brake force $F_2$ will also strongly depend on the contact angle β.

The second brake force $F_2$ may be controlled by changing the contact angle β, e.g. to compensate at least in part a change in the first brake force $F_1$. This is illustrated in FIGS. 2*a* and 2*b*. The first brake force $F_1$ may depend on the amount of wiping material 102A-1 rolled up on the clean material roll 104. For example, the spring 204 may extend increasingly as the wiping material 102 is unrolled from the clean material roll 104, which may lead to a smaller spring force $f_1$ and hence a smaller first brake force $F_1$. This decrease in the first brake force $F_1$ may be compensated at least in part by changing the contact angle β. A winding direction of the wiping material 102A-1 on the clean material roll 104 and a winding direction of the wiping material 102 on the rod 108 may for example be such the contact angle β increases as the amount of wiping material 102A-1 rolled-up on the clean material roll 104 decreases as shown in FIGS. 2*a* and 2*b*. The dotted line in FIG. 2*b* illustrates the path of the wiping material 102 in the configuration of FIG. 2*a*. In this example, the contact angle β increases as the outer radius R of the wiping material 102A-1 rolled-up on the clean material roll 104 decreases. Accordingly, the second brake force $F_2$ increases. The position of the friction element 108 relative to the position of the clean material roll 104 may be chosen such that the increase in the second brake force $F_2$ compensates at least in part a change in the first brake force $F_1$ arising from a change in the amount of wiping material 102A-1 rolled up on the clean material roll 104.

Figure 3:
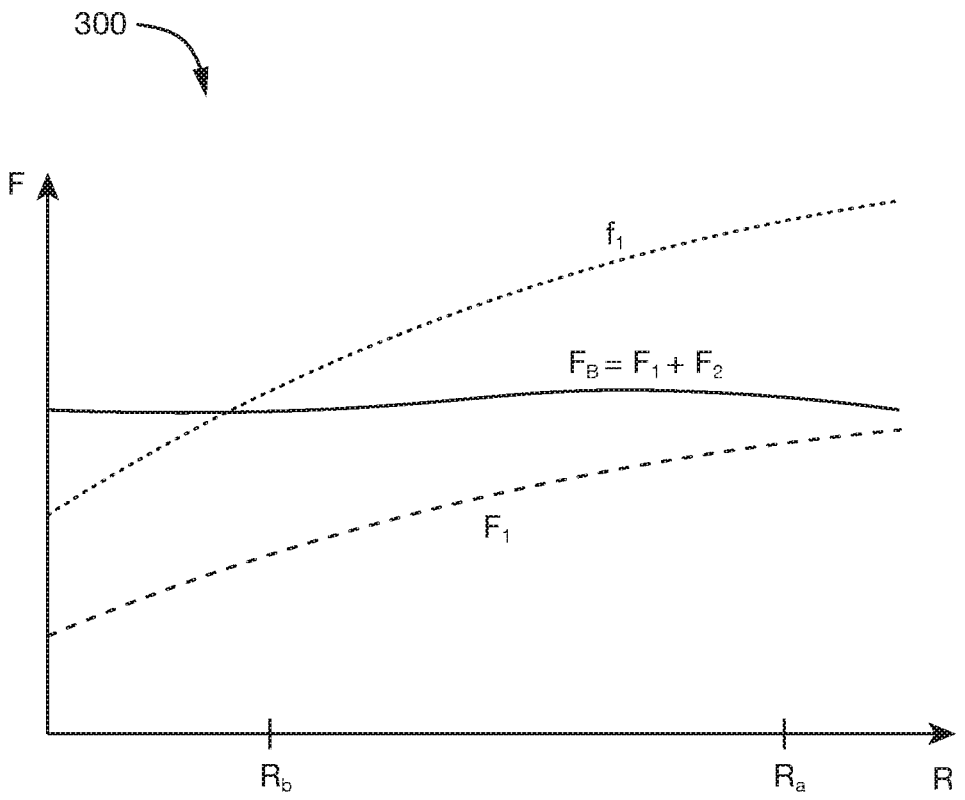
FIG. 3: forces in a wiping material as a function of an outer radius of the wiping material on a clean material roll in accordance with an example.

An example for the evolution 300 of the spring force $f_1$, the first brake force $F_1$ and the total brake force $F_B=F_1+F_2$ as a function of the outer radius R of the wiping material 102A-1 rolled up on the clean material roll 104 is illustrated in FIG. 3. As described above, the spring force $f_1$ decreases with decreasing radius R as the wiping material 102 is unrolled from the clean material roll 104 and the spring 204 extends. The first brake force $F_1$ may be proportional or approximately proportional to the spring force $F_1$ and hence may also decrease with decreasing radius R. By appropriately adjusting the contact angle β, the decrease in the first brake force $F_1$ may be compensated at least in part through an increase in the second brake force $F_2$, e.g. due to an increased friction between the wiping material 102 and the friction element 108, such that the total brake force $F_B$ remains constant or approximately constant independent of the radius R. In one example, the total brake force $F_B$ may change by less than 20%, preferably less than 10% as the wiping material 102 is completely unrolled from the clean material roll 104.

Figure 4:
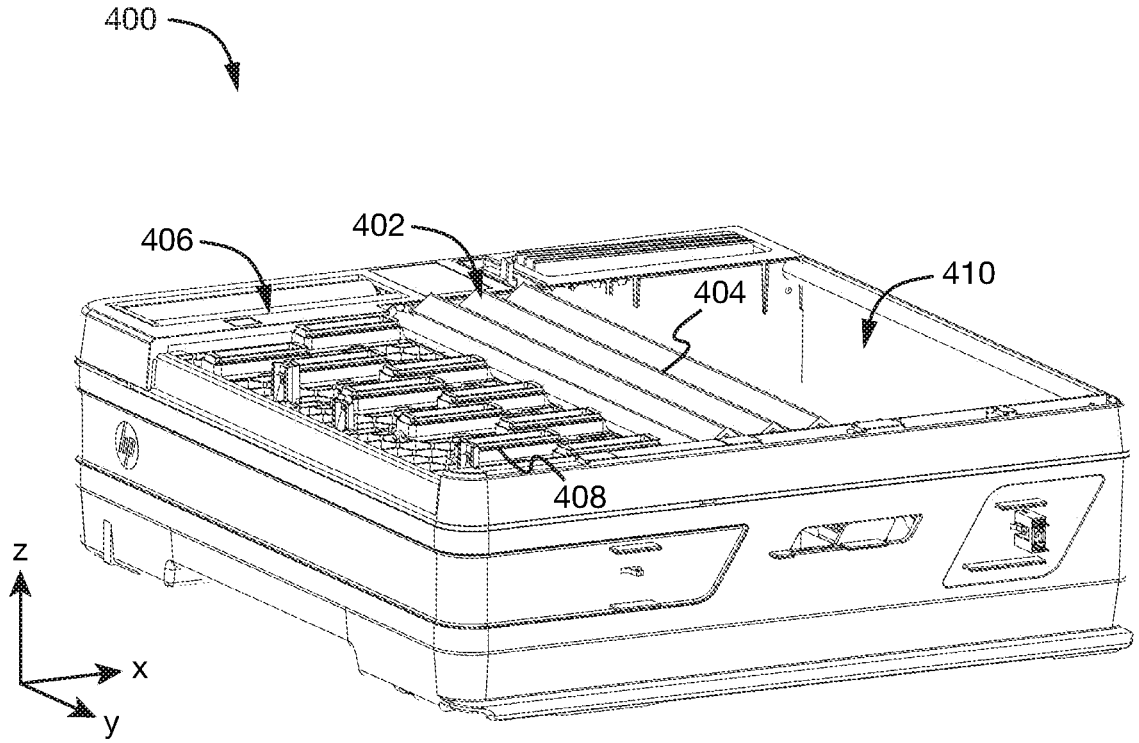
FIG. 4: a maintenance cartridge according to an example in a perspective view.

FIG. 4 depicts a maintenance cartridge 400 according to an example in a perspective view. The maintenance cartridge 400 may for example be employed in a printing device to perform cleaning operations on a print head of the printing device. The maintenance cartridge 400 comprises a wiping subsystem 402 having a number of wipers 404 to press a wiping material 102 against the print head. The wiping subsystem 402 is described in more detail below with reference to FIG. 5. The maintenance cartridge 400 further comprises a capping subsystem 406 having a plurality of caps 408, e.g. to cover a nozzle plate of the print head after the cleaning or when the print head is not in use. For simplicity, only a single cap 408 and a single wiper 404 are provided with reference signs in FIG. 4. The maintenance cartridge 400 also comprises a spittoon subsystem 410 having a reservoir to receive material ejected from the print head. The spittoon subsystem 410 may further comprise a spit roller or transfer unit (not shown) arranged in or adjacent to the reservoir, e.g. to transfer material ejected from the print head into the reservoir.

Figure 5:
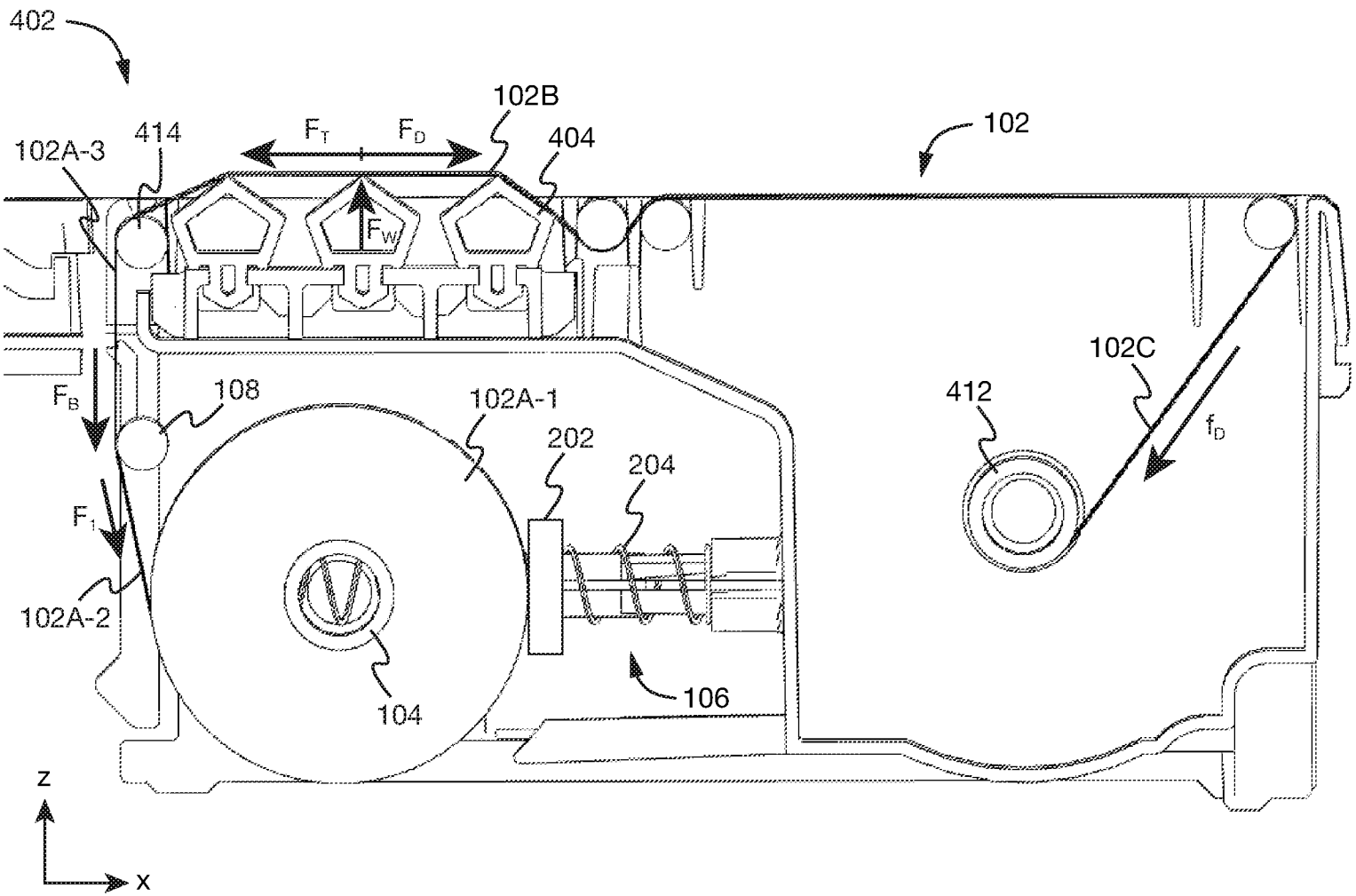
FIG. 5: the wiping subsystem of the maintenance cartridge in FIG. 4 in a sectional view.

A sectional view of the wiping subsystem 402 of the maintenance cartridge 400 is shown in FIG. 5. Similar to the wiping subsystems 100 and 200, the wiping subsystem 402 comprises a wiping material 102 that is to be brought in contact with the print head to wipe off contaminants from the print head. The wiping material 102 comprises a clean part 102A, a cleaning part 102B and a used part 102C. The clean part 102A may e.g. be used for cleaning the print head in the future and is rolled up on a clean material roll 104 at least in part. The cleaning part 102B is arranged on top of a plurality of wipers 404. In the example shown in FIGS. 4 and 5, the wiping subsystem 400 comprises three wipers 404. In others examples, the wiping subsystem 400 may comprise a different number of wipers, e.g. a single wiper. The wipers 404 are to press the cleaning part 1026 against the print head with a wiper force $F_W$ to wipe the print head. The wipers 404 may consist of or comprise a flexible material like rubber such that the wipers 404 may be compressed to generate a spring force pressing the wiping material 102 towards the print head. The used part 102C may e.g. have been used for cleaning the print head previously and may be stored by rolling up the used part 102C on a used material roll 412 at least in part.

The wiping subsystem 402 comprises a brake 106 to generate a first brake force $F_1$ along a longitudinal direction of the wiping material 102 in a first portion 102A-2 of the clean part 102A of the wiping material 102. The brake 106 may e.g. have a spring 204 to press a brake shoe 202 against a portion 102A-1 of the wiping material 102 rolled up on the clean material roll 104. The wiping subsystem 402 further comprises a friction element 108 to convert the first brake force $F_1$ to a friction force along the longitudinal direction of the wiping material 102 in a second portion 102A-3 of the clean part 102A of the wiping material 102 to generate the second brake force $F_2$. In this example, the friction force corresponds to a total brake force $F_B$ that is the sum of the first and second brake forces $F_1$ and $F_2$. The friction element 108 may for example be a rod, wherein the wiping material 102 is wrapped around the rod 108 spanning a contact angle β. As discussed above, the total brake force $F_B$ may then be related to the first brake force $F_1$ through the Capstan equation $F_B=e^{\mu\beta}$. Accordingly, the friction element 108 amplifies the first brake force $F_1$ by an amplification factor $e^{\mu\beta}$. By adjusting the amplification factor, the friction element 108 can compensate at least in part a change in the first break force $F_1$ to control or maintain the total brake force $F_B$. The amplification factor may for example be adjusted by changing the contact angle β, e.g. as described above with reference to FIGS. 2*a* and 2*b*.

The total brake force $F_B$ in the second portion 102A-3 generates a tension force $F_T$ in the cleaning part 102B, wherein the tension force $F_T$ also acts along the longitudinal direction of the wiping material 102. The tension force $F_T$ may be equal to the total brake force $F_B$, e.g. if no additional elements are in contact with the wiping material 102 between the second portion 102A-3 and the cleaning part 102B. In other examples, the tension force $F_T$ may be different from the total brake force $F_B$, e.g. if the wiping material 102 passes by an additional steering element like a deflection rod 414 between the second portion 102A-3 and the cleaning part 102B as shown in FIG. 5. The steering element may e.g. create friction such that the tension force $F_T$ may be larger than the total brake force $F_B$.

The tension force $F_T$ can counteract a driving force $F_D$ in the cleaning part 102B, wherein the driving force $F_D$ may e.g. be applied such that the driving force $F_D$ points from the clean part 102A towards the used part 102C along the longitudinal direction of the wiping material 102. To generate the driving force $F_D$, the wiping subsystem 402 or the maintenance cartridge 400 may comprise an actuator. The actuator may e.g. be coupled to the used material roll 412 to rotate the used material roll 412, thereby creating a force $f_D$ towards the used material roll 412 in the used part 102C. The force $f_D$ in the used part 102C translates into the driving force $F_D$ in the cleaning part 102B, e.g. as described above with respect to the tension force $F_T$. In other examples, the actuator may be coupled to a steering element like a deflection rod, e.g. to rotate or move the steering element to generate the driving force $F_D$. In yet another example, a force may be applied to the steering element, e.g. via a spring, to generate the driving force $F_D$ in the wiping material 102.

When the driving force $F_D$ is applied, the brake 106 generates the tension force $F_T$ acting along the wiping material 102 in a direction opposite to the driving force $F_D$. As long as the driving force $F_D$ is smaller than or equal to the maximum tension force $F_T$, the tension force $F_T$ prevents the wiping material 102 from moving. The two opposing forces $F_T$ and $F_D$ thus create a tension in the cleaning part 102B. The wiper force $F_W$ can depend on the tension in the cleaning part 102B, e.g. due to a compression of the wipers 404 as a result of the tension, which may change the wiper force $F_W$ as detailed below with reference to FIG. 6. The friction element 108 can compensate at least in part a change in the tension force $F_T$, e.g. due to a change in the first break force $F_1$, to control or maintain the wiper force $F_W$. In one example, the wiper force $F_W$ changes by less than 20%, preferably less than 10% as the wiping material 102 is completely unrolled from the clean material roll 104. If the driving force $F_D$ is larger than the maximum tension force $F_T$, the driving force $F_D$ may advance the wiping material 102 from the clean material roll 104 towards the used material roll 412.

Figure 6:
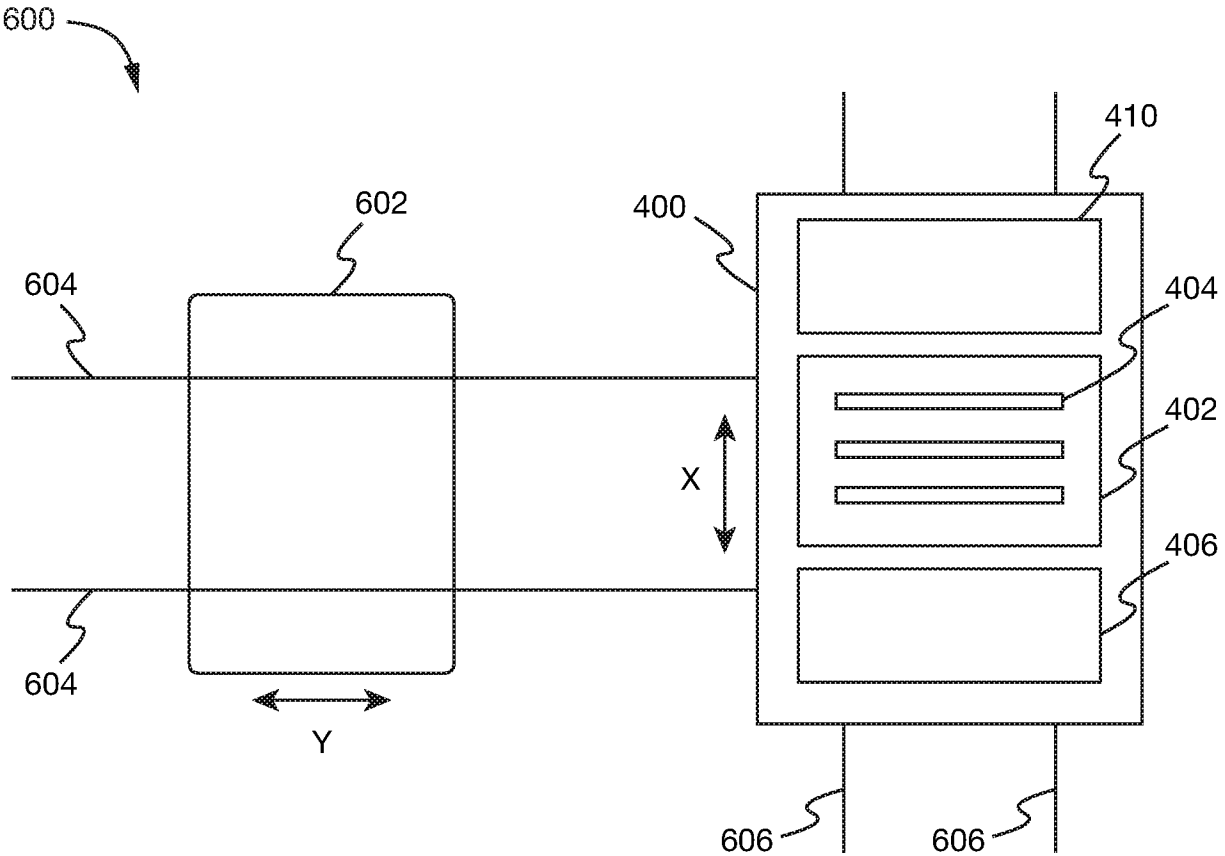
FIG. 6: a printing device in accordance with an example in top view.

FIG. 6 illustrates a printing device 600 in accordance with an example in top view. The printing device 600 comprises a print head 602, e.g. an ink-jet print head having a reservoir for a printing fluid such as ink and a nozzle plate for depositing the printing fluid on a print medium. The print head 602 can be movable along a print head path 604 in a scanning direction, which is illustrated by the arrow labeled "Y" in FIG. 6. The scanning direction may e.g. be perpendicular to a direction of movement of the print medium, also referred to as media advance direction. In other examples, the printing device 600 may be a 3D printer and the print head 602 may be moveable in multiple directions. The printing device 600 may comprise an actuator for moving the print head 602 along the print head path 604, for example an electric motor coupled to a carriage carrying the print head 602 via a drive belt or a gear drive such as a worm drive.

The printing device 600 also comprises a maintenance cartridge, e.g. the maintenance cartridge 400 with the wiping subsystem 402 described above. The maintenance cartridge 400 may e.g. be arranged in a maintenance area adjacent to one end of the print head path 604. In some examples, the maintenance cartridge 400 may be movable along a maintenance path 606 as illustrated by the arrow labeled "X", e.g. to position the maintenance cartridge 400 relative to the print head 602 to perform a cleaning operation with one of the subsystems 402, 406, and 410. The maintenance path 606 may e.g. be aligned with the media advance direction to traverse the print head path 604. To move the maintenance cartridge 400, the printing device 600 may further comprise an actuator, e.g. an electric motor coupled to the maintenance cartridge 400 via a drive belt or a gear drive such as a worm drive.

To wipe the print head 602, the print head 602 and the maintenance cartridge 400 may be brought into a wiping configuration, in which the print head 602 is adjacent to the maintenance cartridge 400. For this, the print head 602 may for example be moved to a cleaning position in the maintenance area, e.g. such that the print head 602 is located above the maintenance cartridge 400 in the direction of view of FIG. 6, and the maintenance cartridge 400 may be moved along the maintenance path 606 to a wiping position. In the wiping configuration, the cleaning part 102B of the wiping material 102 is in contact with the print head 602, e.g. with a nozzle plate on the bottom of the print head 602. The cleaning part 102B is pressed against the print head 602 by the wipers 404 with the wiper force $F_W$.

The wiper force $F_W$ may e.g. depend on the tension in the cleaning part 102B of the wiping material 102 and a distance between the wiping subsystem 402 and the print head 602. When the wiping material 102 is not in contact with the print head 602, the spring force that is generated by the wipers 404 and presses the wiping material 102 upwards may be countered by the tension in the cleaning part 102B, creating a stable equilibrium. When the wiping material 102 comes in contact with the print head 602, the print head 602 may further compress the wipers 404 such that the wipers 404 generate the wiper force $F_W$ in addition to the equilibrium spring force. Accordingly, the wiper force $F_W$ presses the wiping material 102 against the print head 602. If the tension force $F_T$ is too small, the print head 602 may deform or move the wiping material 102 on the wipers 404. This may result in an insufficient cleaning of the print head 602 by the wiping material 102. If the tension force $F_T$ is too large, the tension in the cleaning part 102B may lead to a compression of the wipers 404. This can result in a reduced wiper force $F_W$ or may even prevent contact between the wiping material 102 and the print head 602. This may also affect the quality of the cleaning.

As described above, the tension force $F_T$ results from the first break force $F_1$ generated by the brake 106, which is amplified by the friction element 108 yielding the total break force $F_B$. The friction element 108 is to adjust the amplification factor to compensate at least in part a change in the tension force $F_T$ to control the wiper force $F_W$. A change in the tension force $F_T$ may for example arise from a change in the first break force $F_1$, e.g. due to a change of the amount of wiping material 102A-1 rolled up on the clean material roll 104. To compensate this change at least in part, the friction element 108 and the clean material roll 104 may be positioned such that the contact angle β increases as the amount of wiping material 102A-1 rolled up on the clean material roll 104 decreases. An increase in the contact angle β can enhance the amplification factor, which may compensate the decrease in the first break force $F_1$ at least in part, e.g. to maintain a constant or approximately constant wiper force $F_W$. In one example, the wiper force $F_W$ changes by less than 20%, preferably less than 10% as the wiping material 102 is completely unrolled from the clean material roll 104.

Figure 7:
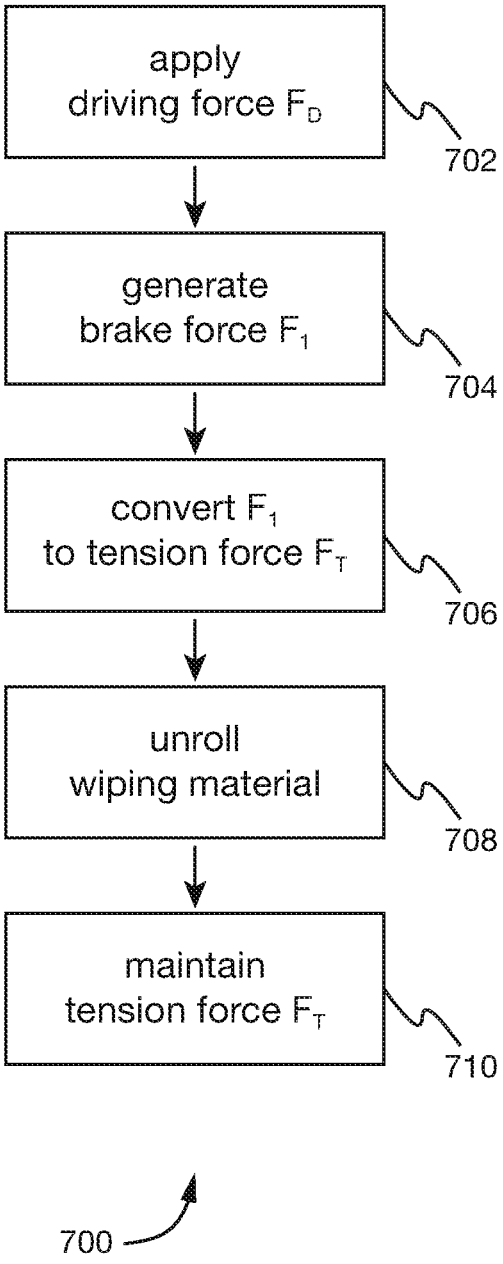
FIG. 7: a flow chart of an example of a method of controlling a wiping subsystem.

FIG. 7 shows a flow chart for an example of a method 700 of controlling a wiping subsystem of a print head maintenance cartridge. The method 700 may e.g. be used to control any one of the wiping subsystems 100, 200, and 402 and is described in the following with reference to FIGS. 2*a*, 2*b*, and 5. This is, however, not intended to be limiting in any way. The method 700 may be executed with any wiping subsystem comprising a wiping material at least partially rolled-up on a material roll.

The method 700 comprises, in 702, applying a driving force $F_D$ along a longitudinal direction of the wiping material 102 in a cleaning part 102B of the wiping material 102. As detailed above, the driving force $F_D$ may for example be generated by an actuator, e.g. an electric motor. The actuator may e.g. be part of or coupled to the used material roll 412 to rotate the used material roll 412 and thereby generate a force along the wiping material 102. In other examples, the actuator may be coupled to a steering element like a deflection rod, e.g. to rotate or move the steering element to generate the driving force $F_D$. In yet another example, a force may be applied to the steering element, e.g. via a spring, to generate the driving force $F_D$ in the wiping material 102.

The method 700 further comprises, in 704, applying a brake force $F_1$ along the longitudinal direction of the wiping material 102 in a brake portion 102A-2 of the wiping material 102 to counteract the driving force $F_D$. The brake force $F_1$ may for example be generated by the brake 106, e.g. by pressing the brake shoe 202 with a force $f_1$ against a portion of the clean part 102A of the wiping material 102. The brake shoe 202 may e.g. be pressed against the portion 102A-1 of the wiping material 102 rolled up on the material roll 104 or against a portion of the clean part 102A that is unrolled from the material roll 104, e.g. a portion of the brake portion 102A-2. In other examples, the brake force $F_1$ may be generated via the material roll 104, e.g. due to friction impeding a rotation of the material roll 104 or by applying a torque to the material roll 104.

In 706, the brake force $F_1$ is converted to a tension force $F_T$ in the cleaning part 102B that counters the driving force $F_D$, i.e. the tension force $F_T$ is equal and opposite to the driving force $F_D$. For example, if the driving force $F_D$ acts away from the material roll 104, the tension force $F_T$ points towards the material roll 104. The counteracting forces create a tension in the cleaning part 102B. Converting the brake force $F_1$ to the tension force $F_T$ refers to modifying the force acting along the longitudinal direction of wiping material 102 such that, if the brake force $F_1$ is applied in the brake portion 102A-2, the tension force $F_T$ acts in the cleaning part 102B instead of the brake force $F_1$. This may comprise changing a direction and/or magnitude of the first brake force $F_1$. Converting the brake force $F_1$ to the tension force $F_T$ may for example comprise generating a second break force $F_2$ along the wiping material 102 e.g. via the friction element 108 as described below in more detail. Additionally, converting the brake force $F_1$ to the tension force $F_T$ may comprise converting the total break force $F_B$ corresponding to the sum of the first $F_1$ and second break forces $F_2$ to the tension force $F_T$, e.g. via additional steering elements like the deflection rod 414.

The method 700 further comprises, in 708, unrolling a part of the wiping material 102A-1 from the material roll 104. This may for example comprise increasing the driving force $F_D$ pointing away from the material roll 104 along the longitudinal direction of the wiping material 102 such that the driving force $F_D$ exceeds the maximum tension force $F_T$. The driving force $F_D$ may be generated as described above. When unrolling a part of the wiping material 102A-1 from the material roll 104, the outer radius R of the wiping material 102A-1 rolled up on the material roll 104 may decrease. As a result of this, the brake force $F_1$ may change, e.g. due to a change of the force $f_1$ pressing the brake shoe 202 against the wiping material 102A-1 on the material roll 104. The force $f_1$ may for example be given by the product of a spring constant of the spring 204 and a length by which the spring 204 is compressed compared to its equilibrium length. As the spring 204 relaxes, the force $f_1$ may decrease as the spring 204 approaches its equilibrium length.

The method 700 further comprises, in 710, compensating at least in part a change in the brake force $F_1$ to maintain the tension force $F_T$ in the cleaning part 102B to be constant or about constant. In one example, the tension force $F_T$ in the cleaning part 102B may change by less than 20%, preferably less than 10% as the wiping material 102 is completely unrolled from the material roll 104. Compensating at least in part the change in the brake force $F_1$ may comprise adjusting The method 700 may comprise wrapping a portion of the wiping material 102 between the brake portion 102A-2 and the cleaning part 102B around the friction element 108 along a contact angle β. The contact angle β is the angle enclosed by the first and last points of contact between the friction element 108 and the wiping the conversion of the brake force $F_1$ to the tension force $F_T$ such that the tension force $F_T$ remains constant or approximately constant, e.g. by adjusting the second break force $F_2$.

The flow diagram shown in FIG. 7 does not imply a certain order of execution of the method 700. As far as technically feasible, the method 700 may be performed in any order and different parts may be performed simultaneously at least in part. For example, the brake force $F_1$ in 704 may be generated simultaneously with the application of the driving force $F_D$ in 702. Furthermore, the brake force $F_1$ may e.g. be converted to the tension force $F_T$ immediately, e.g. such that any driving force $F_D$ applied to the wiping material 102 is immediately countered by the tension force $F_T$. A change in the break force $F_1$ may continuously be compensated for in 710 while unrolling the wiping material 102 in 708 to maintain the tension force $F_T$. The brake force $F_1$ and/or the tension force $F_T$ may be adjusted continuously whenever the driving force $F_D$ is changed.

In one example, the method 700 can further comprise providing a friction element 108. The friction element 108 may for example be used to generate the second break force $F_2$ to convert the break force $F_1$ to the tension force $F_T$, e.g. by pressing an element against the wiping material 102 as in the wiping subsystem 100 or using a deflecting element like a rod in contact with the wiping material 102 as described above with reference to FIGS. 2*a* and 2*b*.

material 102 with respect to the center of the friction element 108. In one example, the friction element 108 may be a cylindrical rod as in FIGS. 2*a* and 2*b*. Alternatively, the friction element 108 may have a different shape, e.g. a rod with an elliptical, rectangular, hexagonal or irregularly shaped cross section.

Compensating at least in part the change in the brake force $F_1$ may comprise changing the contact angle β. As described above with reference to FIGS. 2*a* and 2*b*, increasing the contact angle β may increase the friction between the friction element 108 and the wiping material 102 and may thus generate a larger second break force $F_2$. Accordingly, decreasing the contact angle may decrease the friction between the friction element 108 and the wiping material 102 and may thus generate a smaller second break force $F_2$. Thereby, the second break force $F_2$ may be adjusted to compensate at least in part the change the brake force $F_1$ to maintain at least approximately the total break force $F_B$ and thus the tension force $F_T$.

The friction element 108 may be provided at a fixed position and changing the contact angle β may comprise changing at the friction element 108 an input angle of the wiping material 102 coming from the material roll 104. The input angle may be defined as the angle between the orientation of the wiping material 102 upstream of the friction element 108, i.e. on the side of the material roll 104, and a fixed direction within the wiping subsystem 402, e.g. the orientation of the wiping material 102 downstream of the friction element 108, i.e. on the side opposite to the material roll 104. In the example shown in FIGS. 2*a* and 2*b*, the path of the wiping material 102 between the material roll 104 and the friction element 108, i.e. in the first portion 102A-2, depends on the outer radius R of the wiping material 102A-1 rolled up on the material roll 104, i.e. on the amount of wiping material 102A-1 on the material roll 104. Accordingly, as illustrated by the dotted line in FIG. 2*b*, the input angle and thus the contact angle change as the wiping material 102 is unrolled from the material roll 104. The position at which the friction element 108 is provided relative to the material roll 104 may be chosen such that the change in the contact angle β is sufficient to compensate, at least in part, the change in the break force $F_1$ that arises from unrolling the wiping material 102 from the material roll 104. In other examples, the friction element 108 or the material roll 104 may be movable and changing the contact angle β may comprise moving the friction element 108 and/or the material roll 104 to compensate the change in the break force $F_1$ at least in part.

In one example, the contact angle β is increased as the amount of wiping material 102A-1 rolled up on the material roll 104 decreases, e.g. to compensate a decreasing brake force $F_B$ at least in part by a larger friction between the friction element 108 and the wiping material 102. In FIGS. 2*a* and 2*b* for example, the input angle and the contact angle β are smaller at a larger radius $R=R_a$ of the wiping material 102A-1 rolled up on the material roll 104 as in FIG. 2*a* than at a smaller radius $R=R_b$ as in FIG. 2*b*. The winding direction of the wiping material 102 on the material roll 104 and on the friction element 108 and their relative positions may be chosen such that the contact angle β increases as the wiping material 102 is unrolled from the material roll 104.

This description is not intended to be exhaustive or limiting to any of the examples described above. The print head maintenance cartridge, printing device and method disclosed herein can be implemented in various ways and with many modifications without altering the underlying basic properties.

The invention claimed is:

1. A print head maintenance cartridge with a wiping subsystem, the wiping subsystem comprising:

a wiping material to wipe a print head;

a clean material roll, wherein a clean part of the wiping material is rolled up on the clean material roll at least in part;

a brake to generate a first brake force applied to the wiping material; and a friction element to generate a second brake force applied to the wiping material, wherein the friction element compensates at least in part a change in the first brake force to control a total brake force, wherein the total brake force is the sum of the first and second brake forces; and wherein the friction element is a static element at a fixed position in contact with the wiping material.

2. The print head maintenance cartridge of claim 1 wherein:

the brake is to generate the first brake force along a longitudinal direction of the wiping material in a first portion of the clean part of the wiping material; and the friction element is to convert the first brake force to a friction force along the longitudinal direction of the wiping material in a second portion of the clean part of the wiping material to generate the second brake force.

3. The print head maintenance cartridge of claim 2, wherein the friction element is a rod and a portion of the wiping material connecting the first and second portions is wrapped around the rod spanning a contact angle.

4. The print head maintenance cartridge of claim 3, wherein the friction element is to compensate at least in part a change in the first brake force by a changing contact angle.

5. The print head maintenance cartridge of claim 4, wherein a winding direction of the wiping material on the clean material roll and a winding direction of the wiping material on the rod are such the contact angle increases as the amount of wiping material rolled up on the clean material roll decreases.

6. The print head maintenance cartridge of claim 1, wherein the brake comprises a spring to press a brake shoe against the clean part of the wiping material rolled up on the clean material roll to generate the first brake force; and the friction element is to compensate at least in part a change in the first brake force arising from a change in the amount of wiping material rolled up on the clean material roll.

7. The print head maintenance cartridge of claim 1, wherein the friction element is to compensate at least in part a change in the first brake force to maintain the total brake force to be constant or about constant.

8. The print head maintenance cartridge of claim 1, further comprising an actuator to generate a driving force along the longitudinal direction of the wiping material, wherein the driving force acts in a direction away from the clean roll and the total brake force acts along the wiping material in a direction opposite to the driving force.

* * * * *